US006665878B1

(12) United States Patent
Way

(10) Patent No.: US 6,665,878 B1
(45) Date of Patent: Dec. 23, 2003

(54) JACKET WITH HEAD SOCK AND STORAGE POCKET

(75) Inventor: Damon Way, Vista, CA (US)

(73) Assignee: DC Shoes, Inc., Vista, CA (US)

( * ) Notice: Subject to any disclaimer, the term of this patent is extended or adjusted under 35 U.S.C. 154(b) by 0 days.

(21) Appl. No.: 10/340,471

(22) Filed: Jan. 10, 2003

(51) Int. Cl.[7] ..... A41D 3/02

(52) U.S. Cl. ..... 2/84

(58) Field of Search ..... 2/84, 85, 87, 102, 2/108, 202, 206, 207, 115, 69, 209.1, 171

(56) References Cited

U.S. PATENT DOCUMENTS

| | | | | | |
|---|---|---|---|---|---|
| 2,160,682 | A | * | 5/1939 | Silber | 2/84 |
| 4,017,908 | A | * | 4/1977 | Murnane | 2/114 |
| 4,392,258 | A | * | 7/1983 | O'Neill | 2/209.12 |
| 5,664,259 | A | * | 9/1997 | Budd | 2/115 |

* cited by examiner

*Primary Examiner*—Tejash Patel
(74) *Attorney, Agent, or Firm*—K. David Crockett; Crockett & Crockett

(57) ABSTRACT

A jacket for snowboarding, skiing or snow play has a head sock or balaclava-like hood attached to the inside of the jacket and a storage pocket inside the jacket for storing the hood when not in use.

2 Claims, 2 Drawing Sheets

JACKET WITH HEAD SOCK AND STORAGE POCKET

FIELD OF THE INVENTIONS

The inventions described below relate to outer garments.

BACKGROUND OF THE INVENTIONS

The jacket described below is fitted with a head sock or balaclava-like hood and a pocket on the interior of the jacket for storing the head sock. The jacket is intended for use while skiing, snowboarding, or merely playing or working in environments in which the wearer is exposed to cold weather and snow or other debris which might strike the face during normal use. The head sock covers the face while leaving an opening for the eyes, and can provide protection for the face and neck from cold and blowing snow or debris.

SUMMARY

The jacket described below provides for convenient storage of a head sock in a conveniently located pocket inside the jacket. The lower margins of the head sock are secured to the jacket inner surface or lining, below the neck, such that the head sock forms a neckline powder collar for the jacket when deployed and worn on the wearer'head.

DETAILED DESCRIPTION OF THE INVENTION

Figure 1:
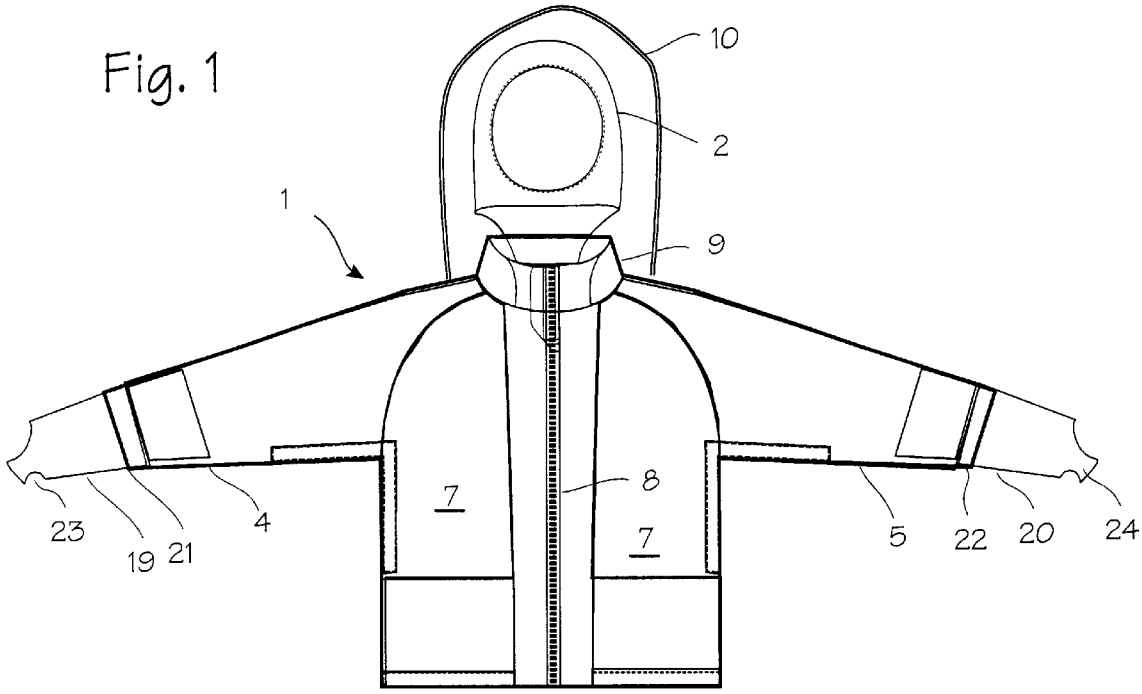
FIGS. 1 and 2 show a jacket with a head sock and a storage pocket for the head sock.
Figure 2:
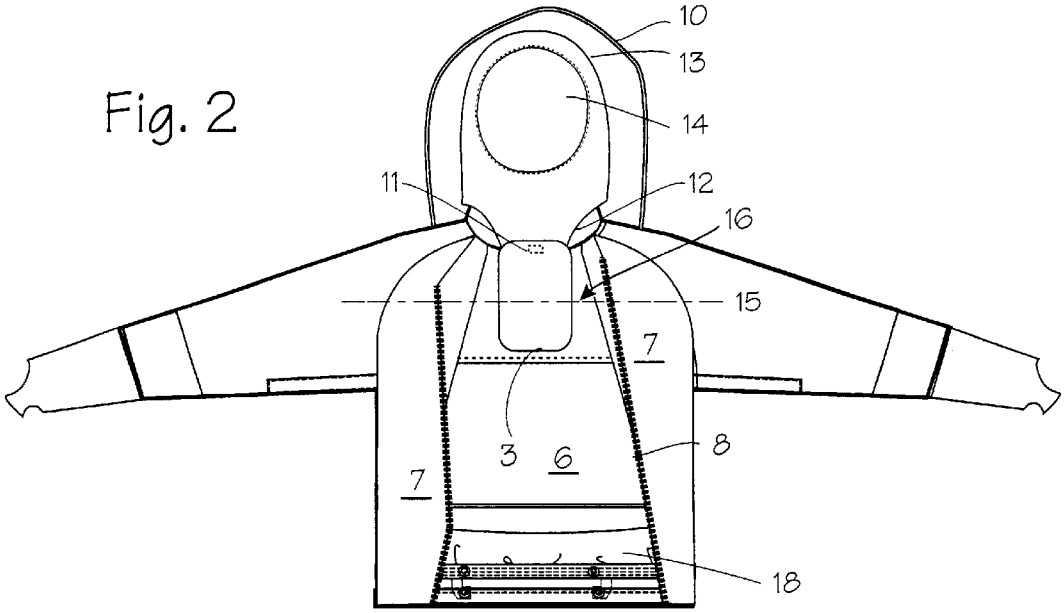

FIGS. 1 and 2 show a jacket 1 with an attached head sock 2 and a storage pocket 3 disposed on the inner surface or lining of the jacket. The jacket also comprises the typical shell comprising sleeves 4 and 5, back panel 6, front panels 7 and front panel fasteners or closures 8. A weather collar 9, which may also be referred to as a collar shell, and a weather hood 10, which may also be referred to as a hood shell or cowl, are also provided on the jacket shell. As the term shell implies, these components provide the primary protection from cold, snow and rain in which the jacket will be worn. In FIG. 2, the jacket is shown from the front, with the front panels spread open so that the interior surface of the jacket is visible. The storage pocket 3 is visible in this view, and is located on the inner surface of the jacket, on the back panel, preferably below the weather collar, with its open end at the upper end of the pocket. The pocket opening is at the top of the pocket, and a small fastener 11 is provided at the opening so that the pocket may be securely closed. Any suitable fastener may be used, such as hook and loop fasteners (Velcro®), snaps, buttons and zippers.

The head sock comprises a neck portion or collar 12, and skull portion 13, and a face portion 14. The head sock is a conformable, close fitting covering for the head and neck with an opening for some or all of the face, and is similar to a balaclava. The bottom of the head sock is preferably secured, along a portion of its circumference, to the inside of the jacket (inside the pocket, or sewn into the seam between the collar shell and the jacket shell). In relation to the wearer, the pocket is located below the neck, for example, vertically located near shoulder blade height indicated by line 15 in FIG. 2. As illustrated, the pocket is disposed in the yoke area 16, which is the area of the back panel which extends from the collar to about the shoulder blades, and corresponds to the area in which a discrete yoke would be located if used. The pocket may instead be disposed on the inside of either front panel. The width of the pocket may match the width of the secured portion of the head sock, which may be 3 to 5 inches, or may extend substantially entirely across the yoke area of the jacket. The collar of the head sock or balaclava-like hood extends from the chin downwardly toward the chest, and is long enough to extend through the weather collar and into the jacket shell when worn. The collar of the head sock preferably completely surrounds the neck, and its circumference is uninterrupted or provided with fasteners operable to close the neck portion. The skull portion is sized and dimensioned to enclose the superior, posterior, and lateral portions of the wearer'head, and the face portion is provided with one or more apertures for the face to provide a fully open face portion or a mask of various degrees of coverage. The head sock is made of spandex, Lycra® or other elastic or stretchable fabric or material. Thus, the head sock acts as a liner or secondary hood to insulate the head (especially when used with the head shell), and may also act as a gaiter or skirt for the neck opening of the jacket, preventing the entry of snow or other debris into the jacket shell.

Figure 3:
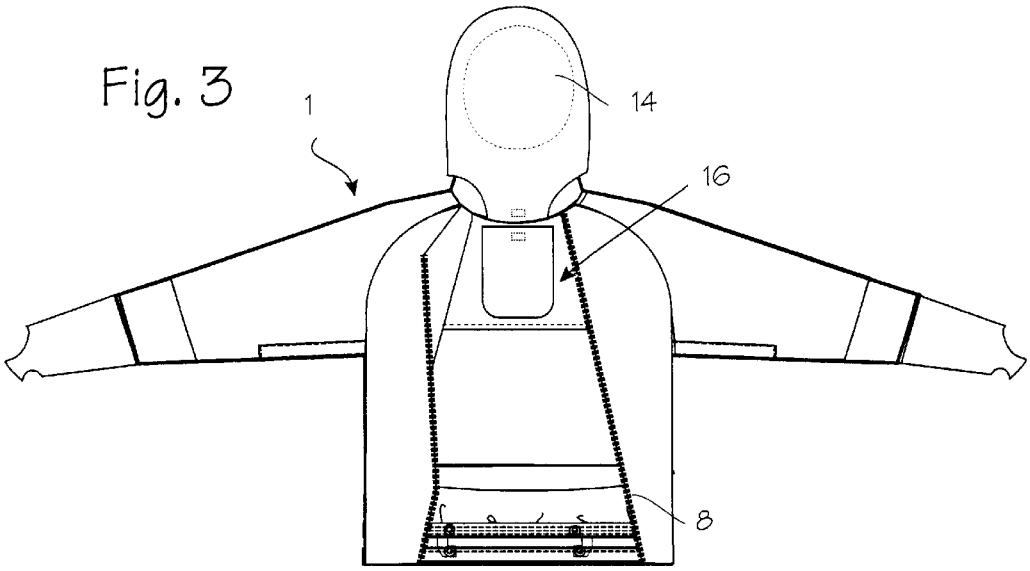
FIG. 3 shows a jacket with a head sock and storage pocket for the head sock in which the head sock is secured in the collar seam of the jacket.
Figure 4:
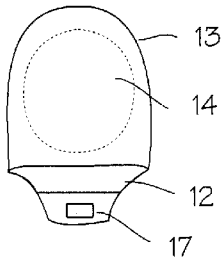
FIG. 4 shows the head sock modified for use with the jacket of FIG. 3.
Figure 5:
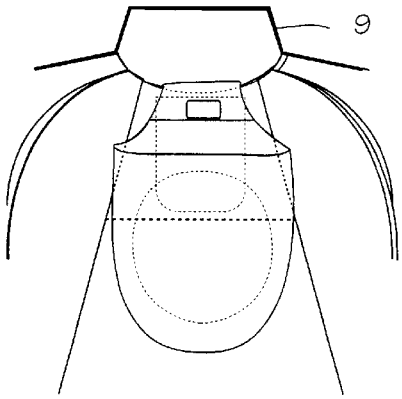
FIGS. 5 and 6 illustrate the relationship of the jacket and head sock of FIGS. 3 and 4.
Figure 6:
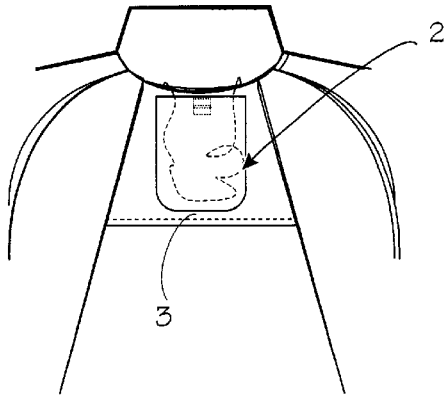

FIGS. 3 and 4 show a jacket with a head sock and storage pocket for the head sock in which the head sock is secured in the collar seam of the jacket, and a head sock modified for use with the jacket. As shown in FIG. 3, the lower end of the head sock is sewn into the seam between the weather collar 9 and the back portion of the jacket shell. The pocket opening is located below the collar seam. As seen in FIG. 4, a fastener 17 is provided on the back of the collar of the head sock. This fastener matches the fastener 11 on the pocket, and is spaced a distance from the fastener on the pocket and attachment point at the collar seam to match the distance from the collar seem to the fastener 11. Thus, as shown in FIGS. 5 and 6, when the hood is allowed to hang from the collar seam, the fastener 17 is suspended in vertical and horizontal alignment with the fastener 11 on the pocket. When the head sock is stuffed into the pocket, the fasteners can be engaged with each other to securely close the pocket and hold the head sock in the pocket during the typical activities of the wearer. Where the head sock is secured to the back panel at a predetermined distance above the fastener on the pocket, and the fastener on the head sock is located a corresponding distance from the lower edge of the head sock, the fasteners will be disposed in proximity to the each other so that the fasteners may be engaged to hold the pocket closed.

In use, the wearer of the jacket may wear the jacket while leaving the head sock in the pocket, and, when desired, remove the head sock from the pocket and place it over his head. Thereafter, during skiing or snowboarding, for example, the head sock will serve to insulate the face and help prevent snow or other debris from entering the jacket through the collar area. When the user no longer desires to wear the head sock, he can remove it from his head and stow it in the pocket.

The jacket may also include a powder skirt 18 fixed to the lower extent of the front and back panels, and cuff gaiters or hand gaiters 19 and 20 secured to the inner surface of the sleeves near the sleeve cuffs 21 and 22. The hand gaiters comprise flexible or elastic sleeves with thumb straps 23 and 24 at their respective distal ends which define apertures for the user'thumb and fingers. The proximal ends of the hand gaiters are stitched to the inside of the sleeves. Regarding the several features of the jacket, the jacket may be provided with a lining, and the storage pocket may be manufactured in the lining with the opening of the pocket on the inside of the jacket, or it may comprise a patch of fabric sewn onto the lining. The closures may comprise snaps, zippers or any other suitable fasteners. The jacket shell, collar shell, and hood shell can be made of any suitable material. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A jacket comprising:

a jacket shell comprising a back panel and a front panel, a collar and a cowl;

a head sock having a lower edge, said head sock being secured to the inside of the back panel at its lower edge;

a pocket on the inside of the back panel for storing the head sock.

2. The jacket of claim 1, wherein the head sock is further characterized by a back, said Jacket further comprising:

a first fastener disposed within the pocket;

a second fastener disposed on the back of the head sock;

wherein the head sock is secured to the back panel at a predetermined distance above the first fastener, and the second fastener is located a corresponding distance from the lower edge of the head sock, such that when the head sock is stored in the pocket, the second fastener is disposed in proximity to the first fastener so that the fasteners may be engaged to secure the pocket.

* * * * *